US010618054B2

(12) United States Patent
Trethewey

(10) Patent No.: US 10,618,054 B2
(45) Date of Patent: Apr. 14, 2020

(54) SYSTEM, MACHINE AND METHOD FOR REDUCING SIZE OR VOLUME OF OBJECTS

(71) Applicant: Risoda Pty Ltd, Deepwater (AU)

(72) Inventor: Reginald Trethewey, Deepwater (AU)

(73) Assignee: Risoda Pty Ltd, Deepwater, New South Wales (AU)

( * ) Notice: Subject to any disclaimer, the term of this patent is extended or adjusted under 35 U.S.C. 154(b) by 394 days.

(21) Appl. No.: 15/517,354

(22) PCT Filed: Oct. 8, 2015

(86) PCT No.: PCT/AU2015/050609
§ 371 (c)(1),
(2) Date: Apr. 6, 2017

(87) PCT Pub. No.: WO2016/054693
PCT Pub. Date: Apr. 14, 2016

(65) Prior Publication Data

US 2017/0304838 A1 Oct. 26, 2017

(30) Foreign Application Priority Data

Oct. 8, 2014 (AU) ..... 2014904009

(51) Int. Cl.
*B02C 18/14* (2006.01)
*B02C 18/06* (2006.01)
(Continued)

(52) U.S. Cl.
CPC ..... *B02C 18/14* (2013.01); *B02C 1/00* (2013.01); *B02C 1/005* (2013.01); *B02C 4/10* (2013.01);
(Continued)

(58) Field of Classification Search
CPC ..... B02C 18/14; B02C 18/02; B02C 18/06; B02C 18/2291; B02C 1/00; B02C 1/005; B02C 4/10
See application file for complete search history.

(56) References Cited

U.S. PATENT DOCUMENTS 2,869,793 A 1/1959 Montgomery
3,473,742 A 10/1969 Montgomery
(Continued)

FOREIGN PATENT DOCUMENTS

WO 94/13442 A1 6/1994

OTHER PUBLICATIONS

PCT International Preliminary Report on Patentability in PCT/AU2015/050609 dated Sep. 14, 2016, 46 pages.
(Continued)

*Primary Examiner* — Omar Flores Sanchez
(74) *Attorney, Agent, or Firm* — Servilla Whitney LLC

(57) ABSTRACT

A machine or system and related method for breaking and reducing the bulk size of one or more objects and comprising: a frame, a reception chamber and a size reduction mechanism. The size reduction mechanism includes a drum rotatably coupled to the frame and configured to oscillate relative to the frame between a first position and a second position about a longitudinal rotational axis; a cutting member coupled to the drum and extending therefrom, the cutting member being configured to penetrate through one or more of the objects in the reception chamber during operation as the drum rotates from the first position to the second position during each oscillation cycle; and a breaking screen comprising a series of spaced breaking members configured to cause further breakdown of the one or more pieces of the one or more objects during operation as the drum rotates toward the second position during each oscillation cycle and forces
(Continued)

the one or more pieces against the breaking members. An optional chute may be coupled to the outlet of the machine or system for further compacting and disposing of the bulk material output by the machine.

17 Claims, 10 Drawing Sheets

(51) Int. Cl.

| | |
|---|---|
| ***B02C 18/02*** | (2006.01) |
| ***B02C 4/10*** | (2006.01) |
| ***B02C 1/00*** | (2006.01) |
| ***B02C 18/22*** | (2006.01) |
| *B02C 18/18* | (2006.01) |

(52) U.S. Cl.
CPC ..... *B02C 18/02* (2013.01); *B02C 18/06* (2013.01); *B02C 18/2291* (2013.01); *B02C 2018/188* (2013.01); *B02C 2201/04* (2013.01)

(56) References Cited

U.S. PATENT DOCUMENTS

| | | | | |
|---|---|---|---|---|
| 3,703,970 | A | 11/1972 | Benson | |
| 7,651,044 | B2 * | 1/2010 | Manola | B02C 4/10 241/254 |
| 2004/0217222 | A1 * | 11/2004 | Okuya | B02C 1/005 241/264 |
| 2005/0116076 | A1 * | 6/2005 | Went | B02C 1/005 241/291 |
| 2008/0282663 | A1 * | 11/2008 | Dunning | A47L 9/1608 56/344 |
| 2014/0166796 | A1 * | 6/2014 | Bonfiglioli | B02C 1/005 241/262 |
| 2014/0319259 | A1 * | 10/2014 | Cheng | B02C 25/00 241/283 |

OTHER PUBLICATIONS

PCT International Search Report and Written Opinion in PCT/AU2015/050609 dated Dec. 22, 2015, 11 pages.

* cited by examiner

SYSTEM, MACHINE AND METHOD FOR REDUCING SIZE OR VOLUME OF OBJECTS

CROSS-REFERENCE TO RELATED APPLICATIONS

This application is the National Stage entry of PCT/AU2015/050609, filed on Oct. 8, 2015 which claims priority to Australian Application Number 2014904009, filed on Oct. 8, 2014, which are incorporated herein by reference in their entireties.

FIELD OF THE INVENTION

The present invention relates to a system, machine and/or method for breaking down and reducing the bulk size and/or volume of one or more objects, such as pallets.

BACKGROUND TO THE INVENTION

In a number of industries, including for example the transportation and construction industries, objects including structures and/or materials are used temporarily and disposed of on a frequent basis. Often, these objects are relatively large and require significant amount of space for storage and/or transportation before disposal. Furthermore, breaking up the objects before disposal can be a laborious and/or time consuming task depending on the type of structure and/or material associated with the object. In some applications, machines have been devised for breaking up objects to reduce the size and storage volume before disposal. However, these machines typically comprise high speed rotor blades that are noisy and dangerous to use.

For example, a pallet is a support structure used in transportation to support goods in a stable fashion while being lifted by a forklift or other jacking device. Most pallets are wooden and comprise a series of parallel timber pieces upon which a multiple boards are affixed to create the support surface of the pallet structure. Pallet dimensions can range depending on the application, but typically pallets are formed to provide a support area of at least 1 $m^2$. Pallets can be formed from an array of materials including wooden or plastics materials.

Most pallets are used in a single transport job and then disposed of or recycled. This creates a space issue for storing and/or transporting the pallets after use if they are not dismantled and/or compacted. Dismantling a pallet is normally time consuming and laborious. For this reason, pallet breaking machines have been conceived to break up and/or compact the pallet volume. However, most of these machines use high speed rotary cutting blades that are noisy and dangerous to use and that can create a dusty environment. This is not only uncomfortable for the operator but it can put their health at risk.

There exists a need for a less harmful system, method and/or machine for breaking down objects prior to disposal.

In this specification where reference has been made to sources of information, this is generally for the purpose of providing a context for discussing the features of the invention. Unless specifically stated otherwise, reference to such information is not to be construed as an admission that such information, in any jurisdiction, is prior art, or forms part of the common general knowledge in the art.

It is an object of the present invention to provide an improved system, machine and/or or method for reducing the bulk size and/or volume of one or more objects that at least partially alleviates the disadvantages associated with existing breaking machines, or to at least provide the public with a useful choice.

SUMMARY OF THE INVENTION

In a first aspect, the invention may broadly be said to consist in a machine for breaking and reducing the bulk size of one or more objects, the machine comprising:

- a frame;
- a reception chamber for receiving and accommodating the one or more objects to be broken;
- a drum rotatably coupled to the frame and configured to oscillate relative to the frame between a first position and a second position about a longitudinal rotational axis;
- a cutting member coupled to the drum and extending therefrom, the cutting member being configured to penetrate through one or more of the objects in the reception chamber during operation as the drum rotates from the first retracted position to the second fully advanced position during each oscillation cycle;
- a breaking screen located within a path traversed by the cutting head as the drum rotates from the first position to the second position to cooperate with the cutting head during operation, the breaking screen is fixedly coupled to the frame and stationary during operation, the breaking screen comprising a plurality of breaking plates extending along a plane substantially orthogonal to a longitudinal axis of the drum and configured to cause further breakdown of the one or more pieces of the one or more objects during operation as the drum rotates toward the second position during each oscillation cycle and forces the one or more pieces against the breaking plates, wherein each breaking plate comprises a leading breaking edge against which the one or more objects or the one or more pieces of the one or more objects are braced and broken against during operation and a curved portion configured to wrap around a portion of a circumference of the drum during operation, and the plurality of breaking plates are substantially parallel and spaced along an axis substantially parallel to the orthogonal axis of the drum and form a magazine within a path traversed by the cutting head during operation for supporting the one or more objects received within the reception chamber during operation.

Preferably the cutting member is configured to cut the one or more objects along a first plane that is substantially parallel to the longitudinal axis of the drum.

Preferably the breaking screen is oriented and configured to break the one or more pieces along a second plane that is substantially orthogonal to the first plane and/or the longitudinal axis of the drum.

Preferably the cutting member comprises a cutting head extending laterally from an outer periphery of the drum, the cutting head extending longitudinally along a length of the drum.

Preferably the cutting member comprises one or more cutting blades extending from the cutting head.

Preferably the cutting member comprises a plurality of cutting blades extending from a longitudinal peripheral edge of the cutting head. Preferably the cutting blades are spaced along the longitudinal peripheral edge of the cutting head. More preferably the cutting blades are uniformly spaced along the longitudinal peripheral edge of the cutting head. Alternatively the cutting member comprises a single longitudinal cutting blade.

Preferably the cutting member is configured to cooperate with the breaking screen during operation to penetrate and cut one or more pieces of the one or more objects as the drum rotates towards the second position and causes the one or more objects to be wedged between the cutting head and the breaking screen.

Preferably the cutting head further comprises a pushing surface extending laterally from the drum between the outer periphery of the drum and the cutting blade(s). Preferably the pushing surface is retracted relative to a leading cutting edge of each cutting blade of the cutting member in a direction toward the second rotatable position of the drum, such that when the one or more objects are in situ and the drum rotates from the first position toward the second position during an oscillation cycle, the one or more objects are contacted and cut by each cutting blade first then pushed toward the breaking screen by the pushing surface.

Preferably the cutting head comprises a main body extending laterally from the drum and longitudinally along at least a portion of the length of the drum.

Preferably the main body comprises a series of spaced slots extending from a face of the body opposing the breaking screen and into the main body across at least a portion of the width of the main body and at least a portion of the depth of the main body. More preferably the each slot extend along the entire depth of the main body. Preferably each slot is configured to receive and accommodate a corresponding member of the breaking member of the breaking screen during operation as the drum rotates from the first position to the second position.

Preferably an upper surface of the main body of the cutting head, most distal and/or opposing the drum, is substantially curved. Preferably a circumferential length of the upper surface is larger than a width of the reception chamber such that the upper surface momentarily shuts off a path between the reception chamber and the drum during operation as the drum oscillates between the first and second positions.

Preferably the main body extends across a portion of the circumference of the drum.

Preferably the cutting member projects laterally from adjacent the upper surface of the main body. More preferably a plurality of cutting blades extend laterally from adjacent the upper surface of the main body, wherein each cutting blade is located between a pair of adjacent slots of the main body and spaced from the adjacent cutting blade(s).

Preferably the breaking screen is fixedly coupled to the frame. Preferably the breaking screen is stationary during operation.

Preferably the breaking screen is located within a path traversed by the cutting head as the drum rotates from the first position to the second position to cooperate with the cutting head during operation.

Preferably the breaking screen comprises a plurality of breaking plates extending along a plane substantially orthogonal to a longitudinal axis of the drum. Preferably each breaking plate comprises a leading breaking edge against which the one or more objects or the one or more pieces of the one or more objects are braced and broken against during operation.

Preferably each breaking plate comprises a curved portion configured to wrap around a portion of the circumference of the drum during operation.

Preferably the plurality of plates are substantially parallel and spaced along an axis substantially parallel to the orthogonal axis of the drum.

Preferably the plurality of plates form the magazine for supporting the one or more objects received within the reception chamber during operation.

Preferably the plurality of spaced plates of the breaking screen are aligned with the plurality of spaced slots of the cutting head such that the plates are received within the complementary shaped slots when the drum is rotated into the second position during each oscillation cycle.

Preferably the machine comprises a substantially enclosed, hollow housing forming the frame to which the drum and breaking screen are fixed, and having a cutting region located adjacent the reception chamber and on one side of the breaking screen for accommodating the drum and the cutting member.

Preferably the housing comprises an collection chamber located on an opposing side of the breaking screen to the cutting region, for accommodating at least some of the broken pieces of the one or more objects output from the breaking screen during operation.

Preferably the reception chamber is located above the cutting region and is oriented with a substantially vertical component allowing the one or more objects received by the chamber to traverse through to the cutting region under the force of gravity during operation.

Preferably the enclosed housing comprises a door adjacent the reception chamber that is pivotable between an open position and a closed position.

Preferably the door is adjacent the reception chamber and in the open position is oriented substantially horizontally to thereby form a mounting platform for placing the one or more objects thereon, and wherein pivoting of the door from the open position to the closed position causes the one or more objects placed thereon to move into the reception chamber and traverse down to the cutting region of the housing.

Preferably the base has feet placed about the periphery for supporting the housing in an upstanding position.

Preferably the drum extends across an entire width of the housing.

Preferably the machine further comprises one or more actuators coupled to the drum for oscillating the drum between the first and second positions. The one or more actuators may be hydraulically, electrically or pneumatically operated actuators for example.

In the preferred embodiment the one or more actuators are hydraulically operated actuators.

Preferably a link arm extends from either end of the drum and is coupled at an end distal from the drum to a linear actuator reciprocally moveable to oscillate the drum.

Preferably the machine further comprises a substantially hollow chute having an inlet at one end and an outlet at an opposing end, wherein the inlet of the chute is configured to couple an outlet of the collection chamber. Preferably a path between the inlet of the chute and the outlet through which bulk material from the collection chamber traverses is angled upwards when the chute is coupled to the collection chamber to cause compaction of the bulk material as it traverses to the outlet of the chute for disposal.

Preferably the chute is outwardly tapered between the inlet and outlet of the chute.

The chute is preferably releasably coupled to the collection chamber but may alternatively be fixedly coupled thereto.

In a second aspect the invention may broadly be said to consist of a system for breaking and reducing the bulk size of one or more objects, the system comprising:

a feeding system for receiving and feeding the one or more objects to be broken into a cutting region;

a drum within the cutting region and configured to oscillate between a first retracted position and a second, fully advanced position about a longitudinal rotational axis;

a cutting member coupled to the drum and extending therefrom, the cutting member being configured to repeatedly penetrate through the cutting region to cut one or more pieces off the one or more objects during operation as the drum rotates from the first position to the second position during each oscillation cycle;

a breaking screen located within a path traversed by the cutting head as the drum rotates from the first position to the second position to cooperate with the cutting head during operation, the breaking screen is fixedly coupled to the frame and stationary during operation, the breaking screen comprising a plurality of breaking plates extending along a plane substantially orthogonal to a longitudinal axis of the drum and configured to cause further breakdown of the one or more pieces of the one or more objects during operation as the drum rotates toward the second position during each oscillation cycle and forces the one or more pieces against the breaking plates, wherein each breaking plate comprises a leading breaking edge against which the one or more objects or the one or more pieces of the one or more objects are braced and broken against during operation and a curved portion configured to wrap a portion of a circumference of the drum during operation, and the plurality of breaking plates are substantially parallel and spaced along an axis substantially parallel to the orthogonal axis of the drum and form a magazine within a path traversed by the cutting head during operation for supporting the one or more objects received within the reception chamber during operation.

In a third aspect the invention may broadly be said to consist of a process for breaking and reducing the bulk size of one or more objects, the process comprising the steps of:

feeding the one or more objects to be broken into a cutting region;

cutting the one or more objects in a first cutting stage using a drum located within the cutting region that is configured to oscillate relative to the frame between a first, retracted position and a second, fully advanced position about a longitudinal rotational axis, the drum having a cutting member coupled thereto and extending therefrom, the cutting member being configured to repeatedly penetrate through the cutting region to cut one or more pieces off the one or more objects during operation as the drum rotates from the first position to the second position during each oscillation cycle; and breaking the one or more pieces cut during the first cutting stage in a second breaking stage by forcing the one or more cut pieces through a breaking screen comprising a series of breaking members configured to cause further breakdown of the one or more pieces of the one or more objects during operation, wherein the breaking screen wraps about a portion of a circumference of the drum and comprises a holder located within a path traversed by the cutting head during operation for supporting the one or more objects received within the reception chamber during operation; and repeating the cutting and breaking stages by oscillating the drum between the first and second positions to continue reduction of object size.

Preferably first cutting stage cuts the one or more objects along a first plane that is substantially parallel to the longitudinal axis of the drum.

Preferably the second breaking stage breaks the one or more pieces along a second plane that is substantially orthogonal to the first plane and/or the longitudinal axis of the drum.

Preferably the method further comprises a further shearing stage after the breaking stage in which the broken down pieces are sheared between the cutting member and the breaking members as the drum continues to rotate toward the second position during each oscillation cycle.

Preferably the step of feeding the one or more objects comprises gravitationally feeding the one or more objects into the cutting region.

In a fourth aspect the invention may broadly be said to consist of a bulk size reduction mechanism for breaking and reducing the bulk size of one or more objects, the mechanism comprising:

a drum configured to oscillate relative between a first, retracted position and a second, fully advanced position about a longitudinal rotational axis;

a cutting member coupled to the drum and extending therefrom, the cutting member being configured to penetrate through one or more of the objects during operation as the drum rotates from the first position to the second position during each oscillation cycle; and a breaking screen located within a path traversed by the cutting head as the drum rotates from the first position to the second position to cooperate with the cutting head during operation, the breaking screen is fixedly coupled to the frame and stationary during operation, the breaking screen comprising a plurality of breaking plates extending along a plane substantially orthogonal to a longitudinal axis of the drum and configured to cause further breakdown of the one or more pieces of the one or more objects during operation as the drum rotates toward the second position during each oscillation cycle and forces the one or more pieces against the breaking plates, wherein each breaking plate comprises a leading breaking edge against which the one or more objects or the one or more pieces of the one or more objects are braced and broken against during operation and a curved portion configured to wrap around a portion of a circumference of the drum during operation, and the plurality of breaking plates are substantially parallel and spaced along an axis substantially parallel to the orthogonal axis of the drum and form a magazine within a path traversed by the cutting head during operation for supporting the one or more objects received within the reception chamber during operation.

Any one or more of the above embodiments or preferred features can be combined with any one or more of the above aspects.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

Number Ranges

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

As used herein the term "and/or" means "and" or "or", or both.

As used herein "(s)" following a noun means the plural and/or singular forms of the noun.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF PREFERRED EMBODIMENT

Figure 1:
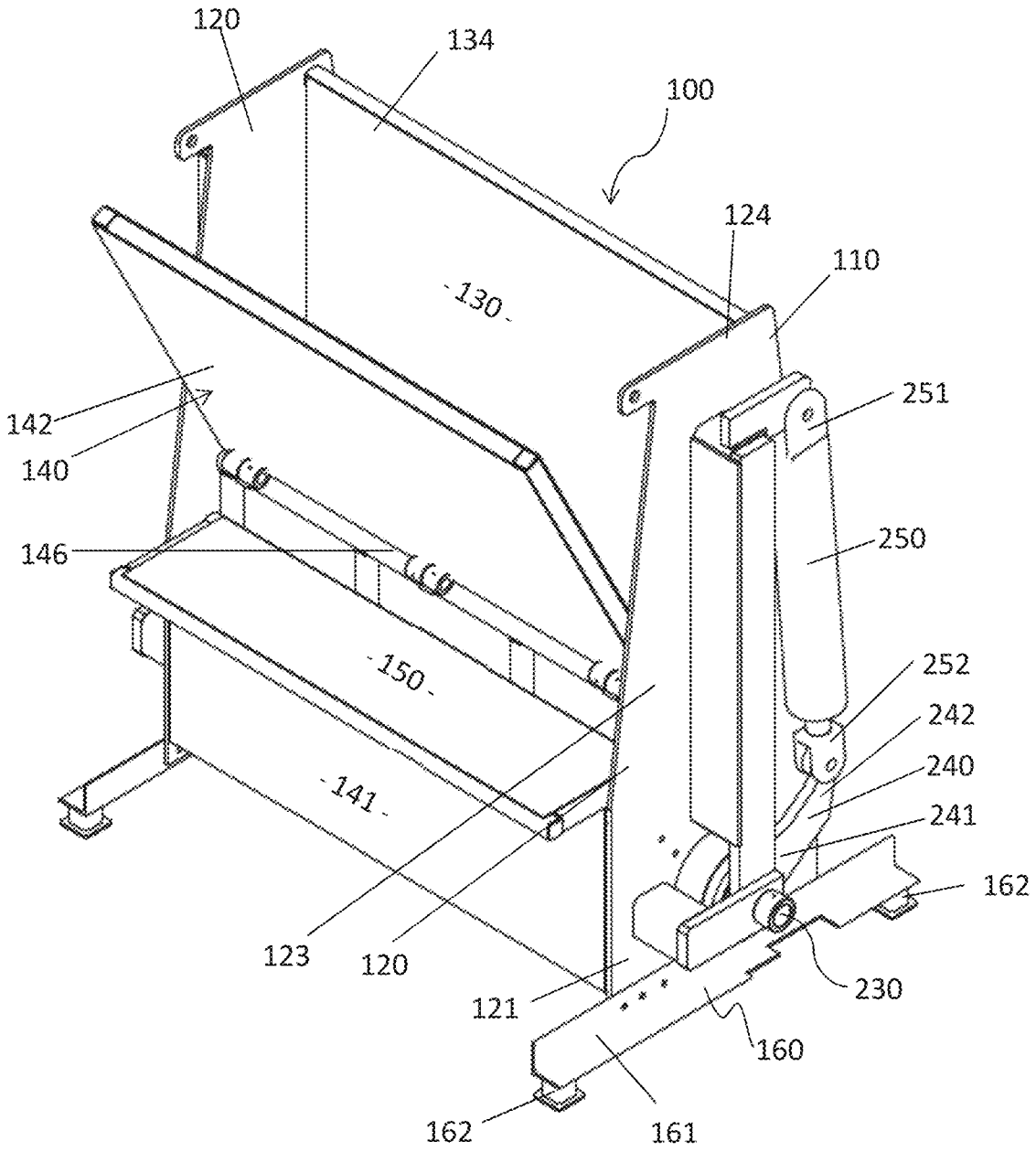
FIG. 1 is a front perspective view of a preferred form bulk size reduction machine of the invention.
Figure 2:
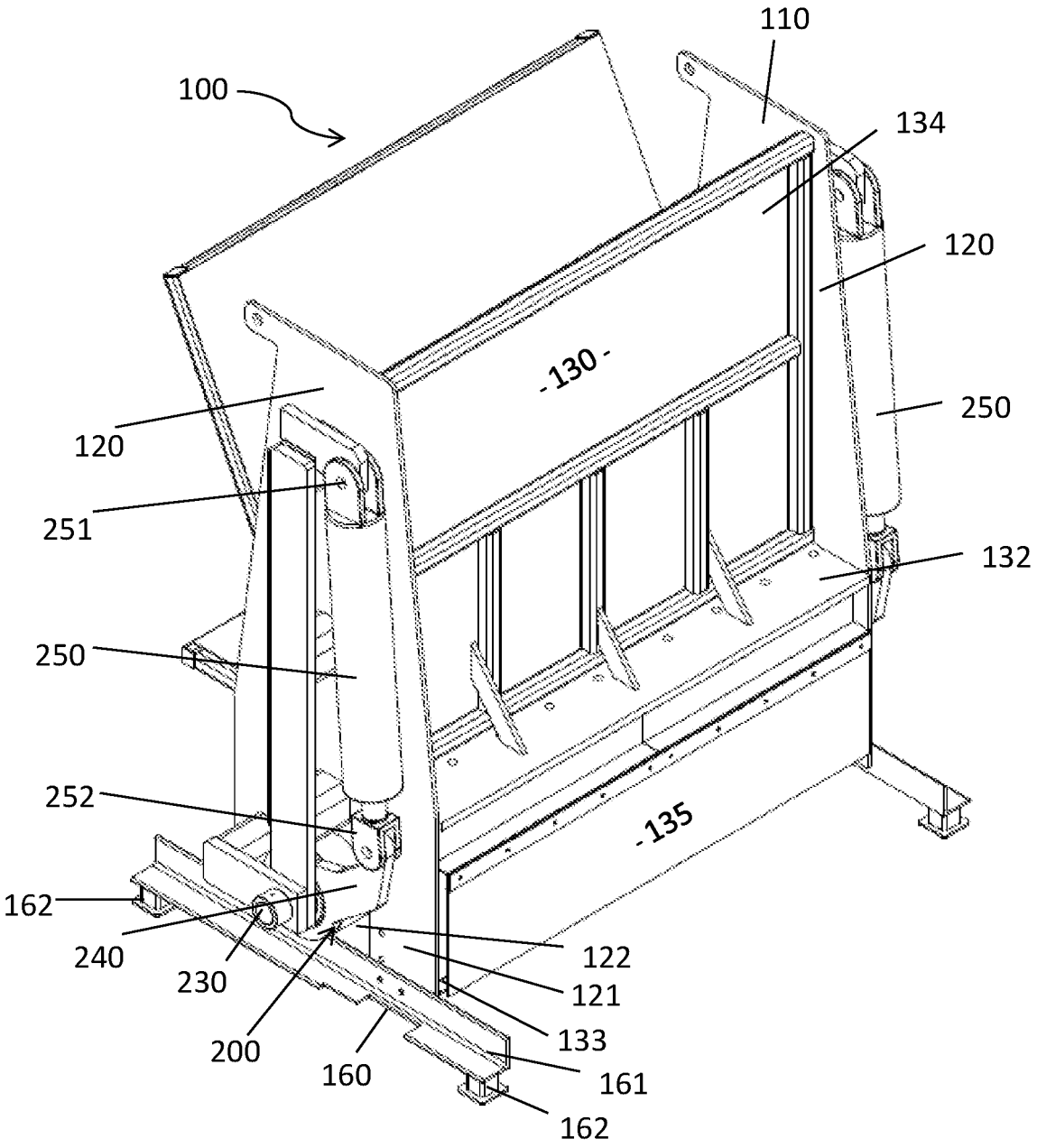
FIG. 2 is a rear perspective view of the preferred form machine of FIG. 1.
Figure 3:
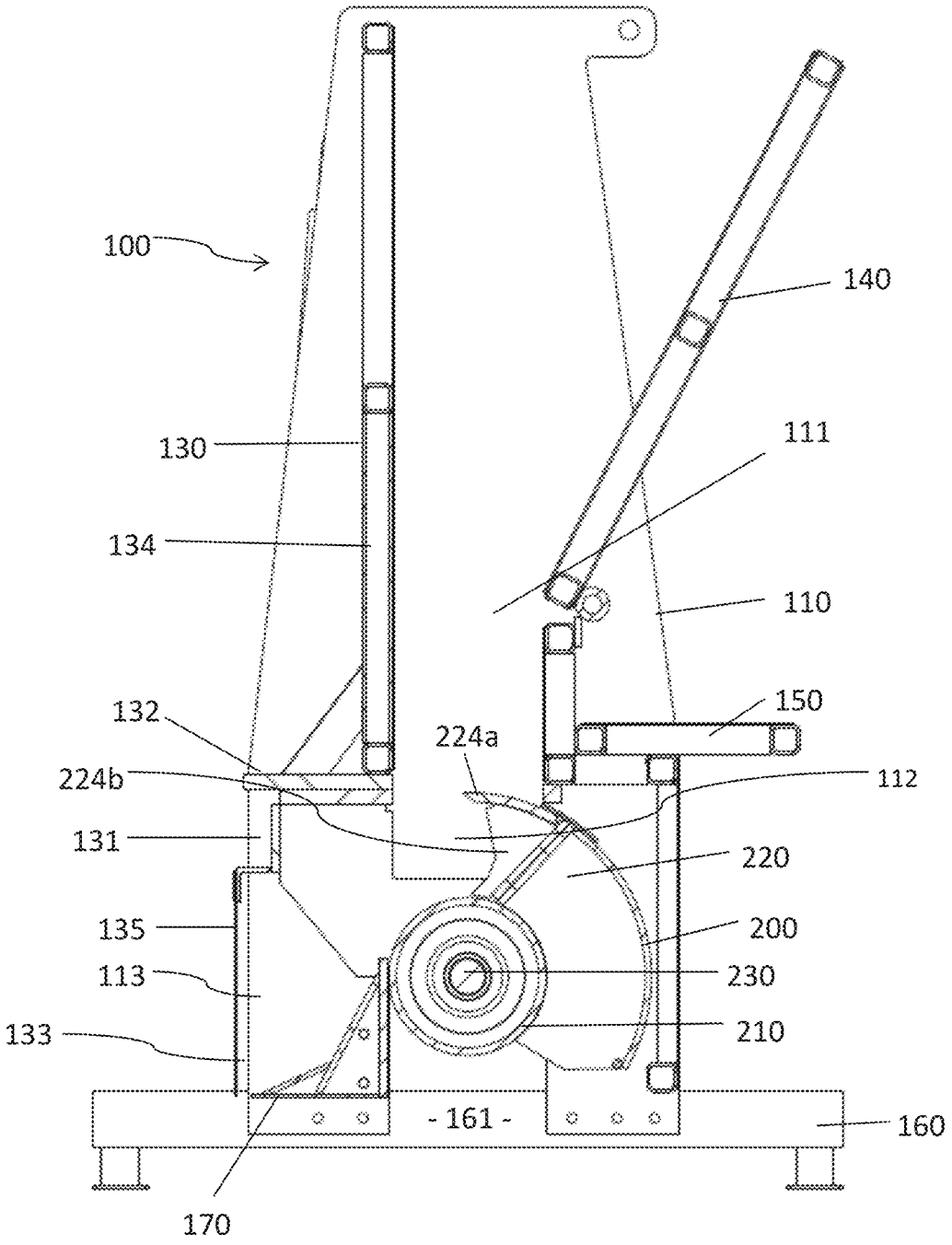
FIG. 3 is a sectional side view of the machine of FIG. 1.

Referring to FIGS. 1-3, a preferred embodiment of a machine 100 operable to reduce the bulk size and/or volume of one or more objects is shown. The construction and operation of the machine 100 and the invention will be described with reference to one or more objects. In the preferred embodiment, the machine 100 is particularly suited for breaking down pallets, and will therefore be described with reference to such in some instances. However, it will be appreciated that the invention is not intended to be limited for use with only pallets and any other object may be broken down using the construction and operation herein described. Such objects can be of any type of structure and/or material that can be handled by the machine, and include for example: wooden structures including timber pieces, softwood or hardwood pieces; plastics structures including plastic pallets and rigid or soft plastics structures; cardboard structures such as tubes; rubber structures such as tyres, as well as a variety of other objects and/or materials. It will be appreciated that the invention is not intended to be limited for use with the above list of objects and/or materials. It is envisaged that the construction and operation of the machine can be tailored for use with any desired object in a variety of industries, including for example the construction and transportation industries.

The machine 100 comprises a mechanical mechanism for breaking down objects in use, and a housing 110 for accommodating the mechanism as well as the one or more objects before and after breakdown. Referring also to FIG. 3 the housing 110 is substantially enclosed and includes a number of internal regions and/or cavities 111-113. A first region forms a reception chamber 111 for feeding one or more objects into the machine 100. The reception chamber 111 is oriented substantially vertically or with a substantially vertical component in the preferred embodiment to allow objects to be gravitationally fed into the cutting region 112 after loading. The cutting region 112 houses the mechanism 200 for size reduction. The cutting region 112 in the preferred embodiment is located beneath the reception chamber 111 and adjacent the base to receive the gravitationally fed objects. During operation, the path between the reception chamber 111 and the cutting region 112 is opened to allow objects to traverse therethrough for size reduction. It will be appreciated, in alternative embodiments, that the reception chamber 111 may be oriented and/or located elsewhere relative to the cutting region 112, for example to the side of the cutting region 112, with the objects being fed thereto using any desired mechanism, such as a powered conveyor belt for instance.

A collection chamber 113 is located adjacent the cutting region 112 and at the output of the size reduction mechanism 200. In the preferred embodiment, the collection chamber 113 is located directly adjacent and to one side of the cutting region 112, however it will be appreciated that in alternative embodiments the collection chamber 113 may be located elsewhere according to the location of the output of the size reduction mechanism 200. For example, the collection chamber 113 may be beneath the cutting region 112 to allow the output pieces to traverse into the collection chamber under the influence of gravity.

The housing 110 is a metal construction, such as a high carbon wear resistant steel and/or stainless steel construction comprising a plurality of plates that are fixedly coupled via welds, fasteners or any suitable mechanism known in the art. It will be appreciated that other materials and/or coupling mechanisms may be used to achieve the preferred form of the housing describe below, including for example a plastics construction.

The housing 110 comprises a pair of opposing side walls 120, an orthogonal rear wall 130 extending between the side walls 120, and a front wall 140 opposing the rear wall and also extending between the side plates 120. The pair of opposing side walls 120 help support the size reduction mechanism. A lower portion 121 of each side wall 120 comprises an opening or aperture 122 for the ends of an internal drum (not shown) to extend therethrough. An actuator 250 of the mechanism 200 is mounted external the housing 110 on an external face 123 of each side wall 120.

Each actuator 250 is fixedly coupled at one end 251 to an upper end 124 of the associated side wall 120 and pivotally coupled at an opposing end 252 to an associated link arm 240 of the mechanism 200. An axle 230 of the mechanism 200 is also fixedly coupled at either end to the external face 123 of each side wall 120. In the preferred embodiment, each side wall 120 has a form comprising a lower end 121 of substantially uniform width for forming the cutting region 112 and the collection chamber 113, and an upper end 124 having a reduced width relative to the lower end 121 for forming the reception chamber 111. The upper end 124 has a tapered width increasing in width toward the lower end 121 in the preferred embodiment. It will be appreciated in alternative embodiments the side wall 120 may comprise other shapes and/or profiles. Furthermore, it will be appreciated that each side wall 120 may be formed as a single plate or from one or more fixedly coupled components or plates.

The housing 110 further comprises a rear wall 130 extending between each side wall 120. The rear wall comprises a stepped profile for complementing the increase in width in the lower end 121 of the side walls 120. In particular an upper end 134 of the rear wall 130 extends substantially in parallel to the general longitudinal axis of the side walls 120 and is connected to a lower end 131 by a step 132 extending outwardly/away from the interior of the housing. The lower end 131 comprises an opening 133. The opening preferably extends across a substantial portion of the width of the housing between the side walls 120. The opening forms an outlet for the collection chamber 113. The rear wall 130 may be formed from separate plates, for example a first plate forming the upper region 134, a second orthogonal plate forming the stepped region 132 and a third open plate forming the lower region 131 of the wall 130. Alternatively the wall may be formed using a single integral plate or any other combination of number of plates and/or components. A cover, door or flap 135 may be optionally attached to the rear wall 130 adjacent the opening 133 to substantially obstruct the outlet 133 and prevent material from exiting the chamber 113 when the machine is in operation for example. It will be appreciated that the cover, door of flap 135 may be fixedly, removably and/or pivotally attached to the rear wall and may be formed from any suitable material. In the preferred embodiment a flap 135 is fixedly attached to the rear wall along a skirt formed about the opening. The flap 135 is made from a soft and flexible material such as a soft plastics or rubber material, to enable the flap 135 to pivot relative to the opening 133 between open and closed positions to allow and obstruct access to the collection chamber 113 respectively. In alternative embodiments a cover may be removably or slidably coupled adjacent the opening for example to prevent and allow access to the chamber 113 as necessary.

The housing 110 further comprises a floor section 170 in the collection chamber 113 to enclose the chamber 113 from the bottom. The floor section 170 is preferably angled downwards toward the ground surface supporting the machine, to encourage the output broken material to move toward the outlet 133 for removal/extraction.

Figure 10:
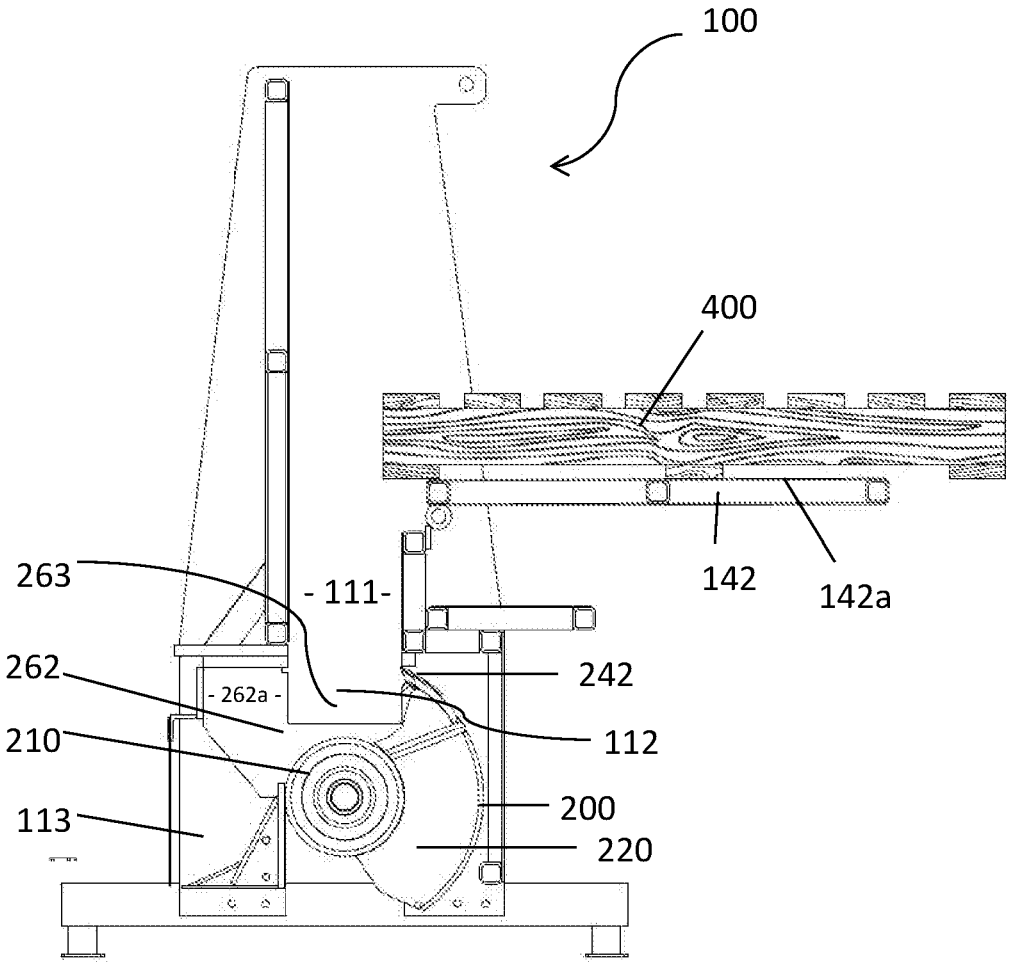
FIG. 10 is a side sectional view of the machine of FIG. 1 in use, showing a loading operational stage.
Figure 11:
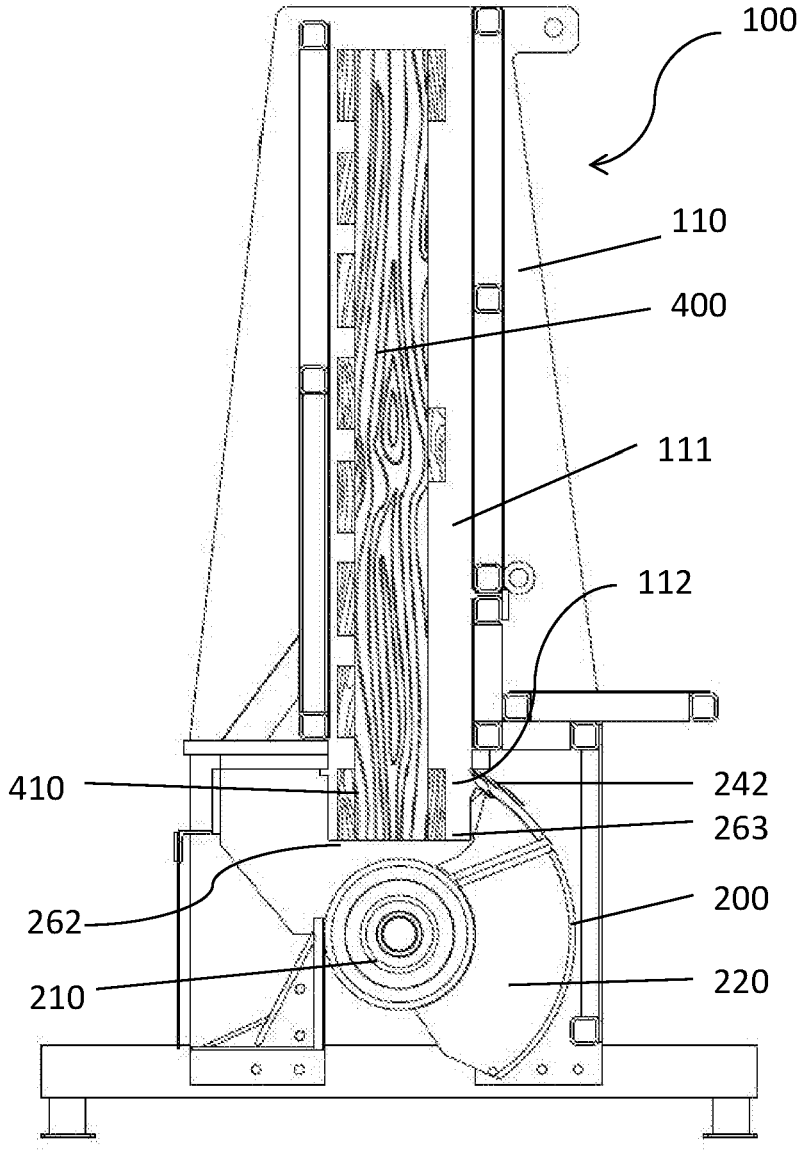
FIG. 11 is a side sectional view of the machine of FIG. 1 in use, showing a loaded and locked operational stage.

The front 140 of the housing 110 opposing the rear wall 130 comprises a stationary lower end 141 extending between and fixedly coupled to the lower ends 121 of the opposing side walls 120 for enclosing the cutting region 112. The upper end comprises a door 142 that is movably coupled relative to the stationary side and rear walls 120, 130 of the housing 110. The door 142 is moveable between an open position in which the interior of the reception chamber 111 is accessible and a closed position in which access to the interior of the reception chamber is prevented or substantially obstructed. In the preferred embodiment the door 142 is pivotally coupled to the side walls (and/or to a lower end of the front wall) via a hinge 146 to pivot about an axis that is substantially orthogonal to the longitudinal axis of the machine. FIG. 10 shows the door in the fully open position where it extends substantially orthogonal to and away from the side and rear walls 120, 130. This configuration not only allows access to the internal reception chamber 111 but also provides a platform **142*a* upon which objects, such as pallets 400, to be broken down can be loaded. FIG. 11 shows the door 142 in the closed position to enclose the reception chamber 111 and the objects 400 retained therein. A locking mechanism may be provided to lock the door in the closed position. Any known locking mechanism, including for example manual and/or electronically operated latching mechanisms may be employed for locking the door in the closed position. In the preferred embodiment, the hinged door 142** is gas strut balanced and the associated locking system includes a spring loaded slam latch on both sides at the free end of the door (not shown).

A platform 150 extends orthogonally from the lower end front wall portion 141 underneath the door hinge 146. This optional feature of the machine allows an operator to step up onto the machine to observe the internal operation of the machine.

The machine 100 further comprises foot structures 160 on either side of the housing 110 for supporting the housing 110 on a surface. Each foot structure is coupled to a lower end 121 of a corresponding side wall 120 and comprises a longitudinal L-shaped plate 161 with stabilising feet 162 extending from either end. The longitudinal plate 161 is fixedly coupled to the associated side wall 120 to extend substantially in parallel to the side wall 120. Also, each base plate 161 is preferably substantially longer in length than the width of the lower end of the associated side plate to extend significantly past either side of the side plate 120 to improve balance and stabilisation of the housing 110.

Referring now to FIGS. 3-8 the preferred form size reduction mechanism 200 of the invention comprises a longitudinal drum 210 rotatably coupled about an axle 230 and having a cutting member comprising a cutting head 220 and one or more cutting blades 224 fixedly coupled thereto. The axle 230 is fixedly coupled to a frame such that the drum 210 is rotatable about the axle 230 during operation relative to the frame. In the preferred embodiment the axle is coupled to the housing 110 and in particular on either end of the axle to the side walls 120. A breaking screen 260 is fixedly coupled to the frame adjacent the drum 210 to cooperate with the cutting head 220 during operation, as will be described in further detail below. In the preferred embodiment the breaking screen 260 is fixedly coupled to an interior wall of the step 132 of the rear wall 130 of the housing 110. In the preferred embodiment, the drum 210 extends along a substantial portion of the width of the housing 110 between the side walls 120. The cutting head 220 and the breaking screen 260 also extend along a substantial portion of the length of the drum 210. The drum 210 and the cutting head 220 reside within the cutting region 112 of the housing. The breaking screen 260 is located within the path traversed by the cutting head 220 as the drum 210 rotates towards the collection chamber 113 during operation. In the preferred embodiment, the breaking screen 260 is fixed to reside adjacent or between both the cutting region 112 and the collection chamber 113 within the housing 110. It will be appreciated however that the axle 230 and/or breaking screen 260 may be fixedly coupled to a frame or the housing 110 elsewhere in alternative embodiments without departing from the scope of the invention provided it is located within the path traversed by the cutting head 220 during operation.

A link arm 240 extends from either end of the drum at an angle substantially orthogonal to the axle 230 and/or longitudinal axis of the drum 210. The link arm 240 may be integrally formed with the drum or separately formed and fixedly couple via any well-known fixing method, such as welding or fastening. Each link arm 240 is rotatably coupled about the axle 230 at one end 241 and to an end 252 of an associated actuator 250 at an opposing end 242 (see FIG. 1). Each actuator 250 is operable to move the end 242 of the link arm 240, which in turn causes rotation of the arm 240 and the drum 210 about the axle 230. In the preferred embodiment each actuator 250 is a linear actuator that is pivotally coupled at one end 252 to the end 242 of the associated link arm 240. The other end 251 of the actuator is fixedly coupled to a frame, and in the preferred embodiment to an upper end 124 of an associated side wall 120 of the housing 110. In this manner, linear movement of the actuator 250 translates into pivotal movement of the associated link arm 240 and drum 210. Each linear actuator 250 is preferably a hydraulically operated actuator 250 but may be alternatively pneumatically or electronically operated as will be appreciated by those skilled in the relevant art. In some embodiments a single link arm and actuator may be used to rotate the drum during operation.

During operation, each actuator 250 is actuated to reciprocate back and forth, thereby increasing and decreasing in length. Both actuators are actuated in synchronisation to move either end of the drum 210 in the same manner. The link arms 240 translate the reciprocal lengthening and shortening of each actuator 250 into rotational oscillation of the drum 210 about the axle 230. Each oscillation cycle includes a forward rotational stroke and a reverse rotational stroke. During forward rotation the cutting head 220 of the drum rotates toward the breaking screen 260 and the collection chamber 113 and in the reverse rotation the cutting head 220 of the drum moves away from the breaking screen 260 and the collection chamber 113. This pattern is repeated to break down the objects received by the machine during operation.

In the preferred embodiment, the actuators 250 are configured to rotate the drum 210 such that the angle of rotation of each stroke of the oscillation cycle is less than 360 degrees. In this manner the drum does not complete a full revolution about the axle 230. Preferably the angular range of rotation is approximately between 0 and 90-270 degrees, more preferably the angular range of rotation is approximately between 0 and 90-180 degrees, more preferably the angular range of rotation is approximately between 0 and 90-180 degrees, even more preferably the range is between 0 and 90-125 degrees and most preferably between approximately 0 and 110 degrees. In the preferred embodiment, the actuator is operable to cause oscillation of the drum with a frequency in the range of approximately 0.05-0.2 Hz (about 5-20_second oscillation periods), more preferably between approximately 0.07-0.15 Hz (about 6.5-14 second oscillation periods) or most preferably between approximately 0.1-0.15 Hz (6.5-10 second revolution periods). This is considered relatively low speed compared to existing high speed rotary breakers and presents several advantages as described in further detail below. It will be appreciated that other relatively low speed frequency ranges of operation are intended to be included within the scope of the invention.

It will be appreciated by those skilled in the relevant art that in alternative embodiments a different mechanism for rotating the drum 210 may be utilised with or without the link arms and/or linear actuators; for example an electric motor may be coupled to the drum to actuate rotation of the drum in the desired manner.

In the preferred embodiment the actuators 250 are each coupled to an on-board electric motor (not shown) that is powered by an external power supply. The electric motors are controllable via an electronic control system. One or more inputs associated with the electronic control system allow an operator to initiate and control operation of the electric motors and actuators 250. When the system is actuated hydraulic fluid is directed to the opening side of the actuator which causes the actuator to extend and the drum to rotate toward the breaking screen 260. When the actuator is fully extended a limit switch is activated which electronically directs the fluid flow to the closing end of the actuator allowing to retract and rotate the drum in the reverse direction to complete one oscillation cycle. The electronic control system may be programmable/configurable to alter the oscillation profile, including speed and range for example. The control system may be preprogrammed with a preset list of oscillation profiles. In the preferred embodiment, an overload function is also programmed into the system to prevent possible machine damage. It will be appreciated that the one or more inputs may be local, on or near the machine, and/or remote, for example part of a computer system that is remotely communicatively coupled to the electronic control system of the machine. The electronic control system may be implemented with a general purpose processor, a digital signal processor (DSP), an application specific integrated circuit (ASIC), a field programmable gate array (FPGA) or other programmable logic component, discrete gate or transistor logic, discrete hardware components, or any combination thereof designed to perform the functions described herein.

The cutting head 220 may be integrally formed with the drum 210 or separately formed and coupled to the drum 210 via any conventional fixing method, such as welding or fastening. As shown in FIGS. 4-7, the cutting head 220 comprises a main body portion 221 projecting outwardly from an outer peripheral wall 213 of the drum 210. The main body portion 221 is preferably substantially arcuate or arch-like in cross-section and extends concentrically about a portion of the circumference of the drum 210. One or more cutting blades 224 extend from an edge or face 223 of the body 221 in the direction of forward rotation of the drum, toward the breaking screen 230 and/or the collection chamber 113. In the preferred embodiment, the cutting member comprises a series of cutting blades 224 extending laterally from and aligned along the edge or face 223 of the body 221 (that is facing the breaking screen 260 and/or collection chamber 113). In the preferred embodiment the plurality of cutting blades 224 are uniformly spaced along the edge or face 223 of the body. In alternative embodiments, a single cutting blade may extend along a substantial portion of the length of the face 223 for example.

Figure 6:
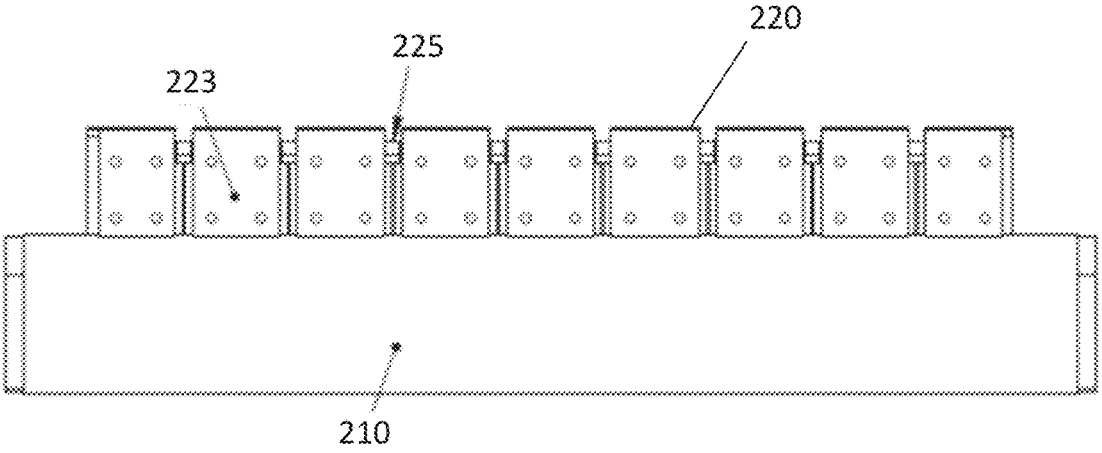
FIG. 6 is a front view of the drum and cutting head of FIG. 5.
Figure 7:
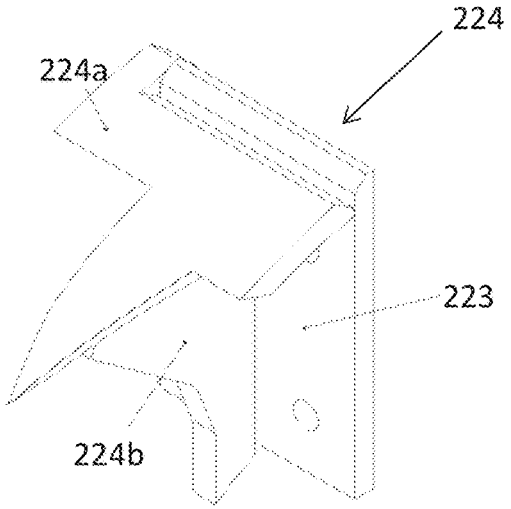
FIG. 7 is a close-up perspective view of a cutting blade of the cutting member of the mechanism of FIG. 4.

As shown in FIG. 7, the free edge of each blade 224 is sufficiently sharp along a substantial portion of the length of the edge to allow the blade to penetrate and cut through various materials, such as wood, plastics and/or rubber, as the drum 210 rotates in the forward rotational direction during operation. In the preferred embodiment, each blade 224 comprises two portions an upper cutting portion **224*a* and a lower cutting portion 224*b*. The upper cutting portion comprises a cutting tooth that is generally tapered and that ends in a sharp apex. The tooth 224***a* of the blade extends laterally from an upper edge of the face 223 and includes a major face that is substantially orthogonal to face 223. The leading edges of the tooth 224*a* are sharpened to allow the tooth to penetrate and cut the objects it is forced through by the rotating drum during operation. A lower protruding rib 224*b* extends laterally from the face 223 beneath the tooth 224*a* of each blade 224, and preferably along a substantial portion of the height of the face 223. The cutting rib 224*b* is oriented substantially orthogonally to the face 223 and the tooth 224*a*. The rib 224*b* preferably extends out from the face 223 less than the upper tooth 224*a*. The leading edge of the rib 224*b* is sharpened to allow it to penetrate and cut the objects it is forced through by the rotating drum during operation. The upper and lower cutting portions of the blade 224 may be formed integrally or separately. The blade 224 may be formed integrally with the face 223 or as in the preferred embodiment fixedly coupled via fasteners or other well-known mechanism. As shown in FIG. 6, in the preferred embodiments plates 223 are fixed to an end of the cutting head between slots 225 for providing the face 223 upon which the blades 224 are fixed to extend therefrom. The plates may be releasably coupled and interchangeable for servicing and maintenance purposes.

Figure 4:
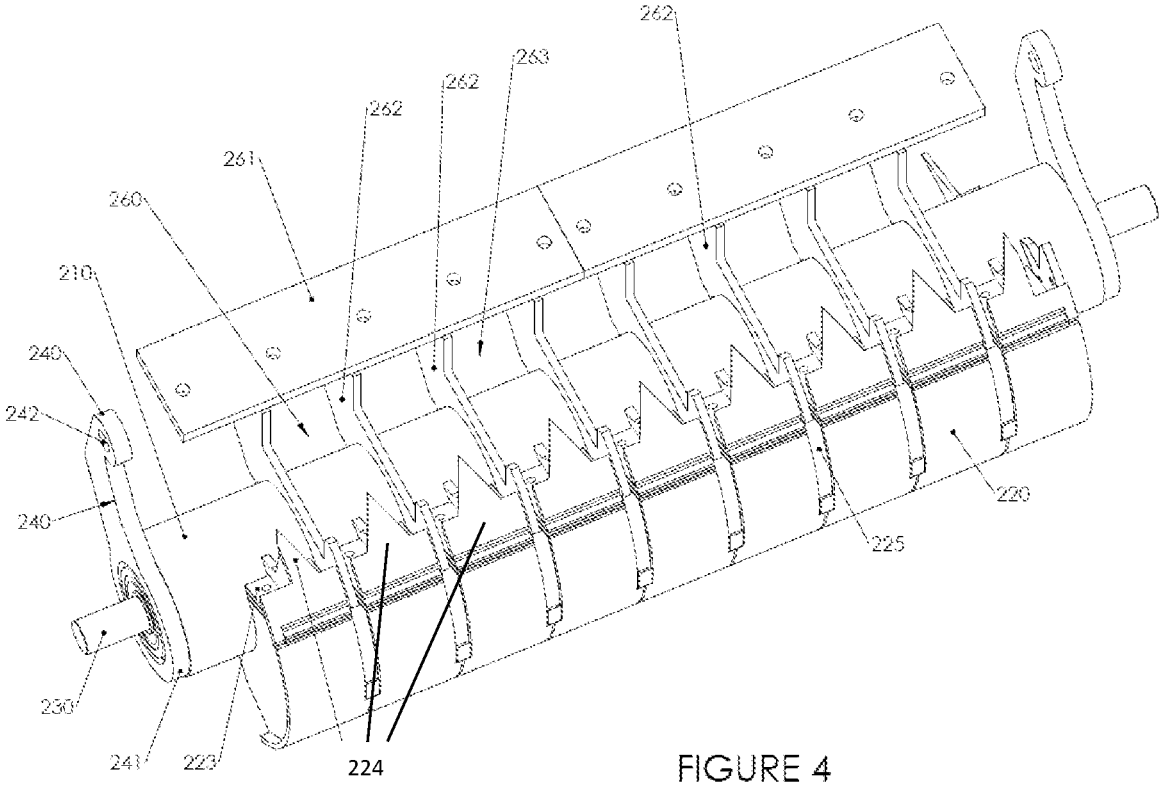
FIG. 4 is a perspective view of the bulk size reduction mechanism of the preferred form machine of FIG. 1.
Figure 5:
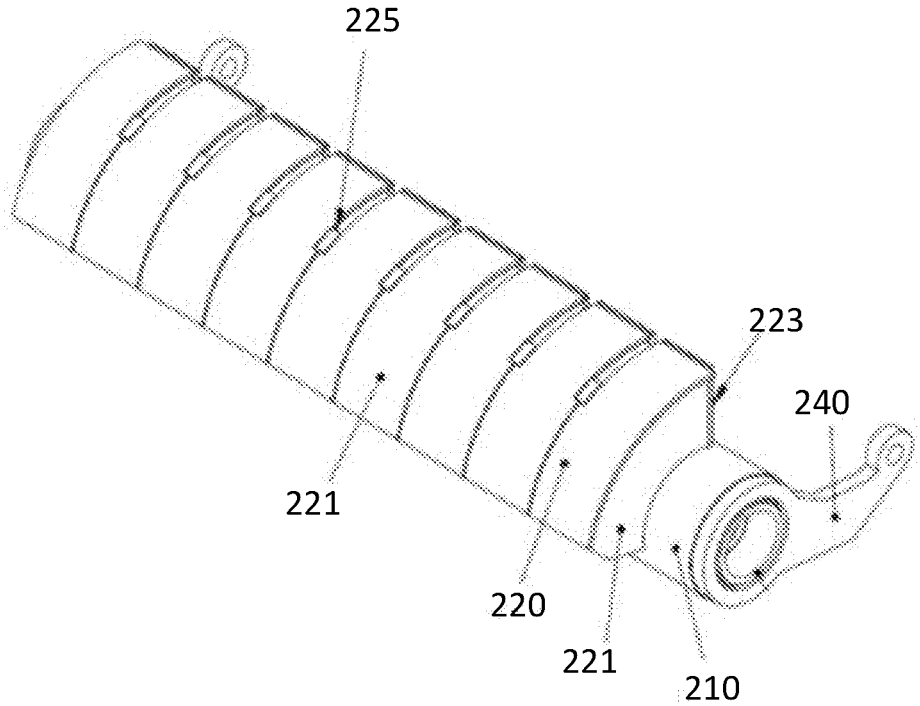
FIG. 5 is a perspective view of the drum and cutting head of the bulk size reduction mechanism of FIG. 4 with the cutting blades removed.

As shown in FIGS. 4 and 5, the main body 221 of the cutting head 220 comprises a series of arcuate slots 225 extending from the face 223 toward the rear of the body 221. The arcuate slots 225 are alternately located between the series of blades 224 and uniformly spaced along the length of the cutting head 220. The slots 225 are shaped and sized to receive corresponding and complementary plate members 262 of the breaking screen 260 during operation. In particular, as the drum 210 rotates toward the breaking screen 260 and collection chamber 113, the plate members 262 come into engagement with the cutting head 220 and are received by the slots 225 during operation.

Figure 8:
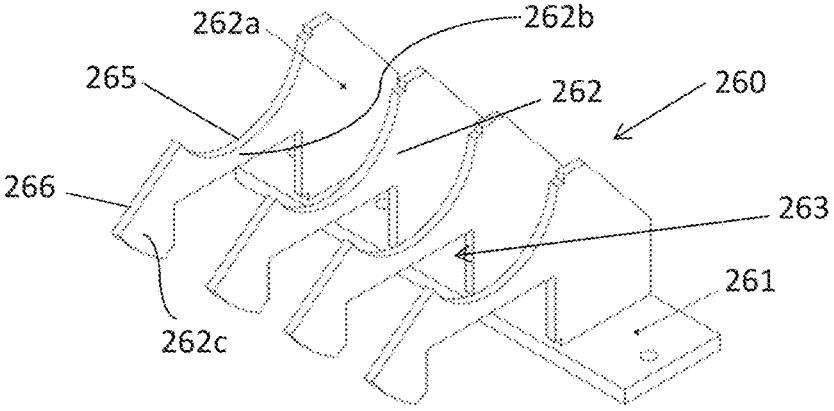
FIG. 8 is a close-up bottom perspective view of a breaking screen of the mechanism of FIG. 4.

As shown in FIG. 8, the breaking screen 260 comprises a mounting plate 261 and a series of spaced breaking plates 262 extending downwardly and outwardly from the mounting plate 261 toward the drum. It will be appreciated that there may be more than one mounting plate, each comprising one or more breaking plates provided the final structure includes a series of spaced breaking plates 262 that can be fixedly coupled to the frame or housing 110. The mounting plate 261 enables breaking screen 260 to be fixedly coupled to the housing 110. In some embodiments, each breaking plate 262 can be fixedly coupled directly to the housing 110 (without the need for a mounting plate). The series of spaced breaking plates 262 form a screen or grating that breaks objects forced against it before allowing them to traverse through to the other side.

Each breaking plate 262 extends in a direction towards the drum 210 and is generally oriented substantially orthogonal relative to the longitudinal axis of the drum/axle 230. Each breaking plate 262 comprises: a first portion 262*a* that extends substantially orthogonally from the mounting plate or the mounting surface; a second portion 262*b* extending substantially orthogonally from the first portion in the direction of the drum and having an arcuate under-edge 265 that is shaped and sized to complement the outer periphery of the drum 210 to thereby wrap around a portion of the drum 210; and an angled end portion 262*c* that includes a substantially flat and sufficiently thin under-edge 266 that is configured to cause an object braced against it to break into two pieces. During operation, as the drum rotates in the forward direction toward the breaking screen 260, the terminal end portion 262*c* of each breaking plate 262 traverses between the corresponding pair of adjacent blades 224 of the cutting head 220 and eventually into the corresponding slots 225 in the cutting head body 221. This relative movement between the breaking plates 262 and the cutting head 220 in the forward direction of the drum is what results in the cutting and breaking action of the machine as will be described in further detail below. As the drum rotates in the reverse direction, the breaking plates 262 are extracted out of the slots and move away from the blades 224 to clear the space there between.

As shown in FIGS. 4 and 11, in the fully retracted position of the drum 210 (in which it is rotated away from collection chamber) the intermediate portion 262*b* of the breaking plates 262 along with the upwardly angled end portion 262*c* create a magazine or cavity 263 in the cutting region 112 for receiving the objects to be reduced in size as they are fed into the cutting region 112 from the reception chamber 111.

Figure 9:
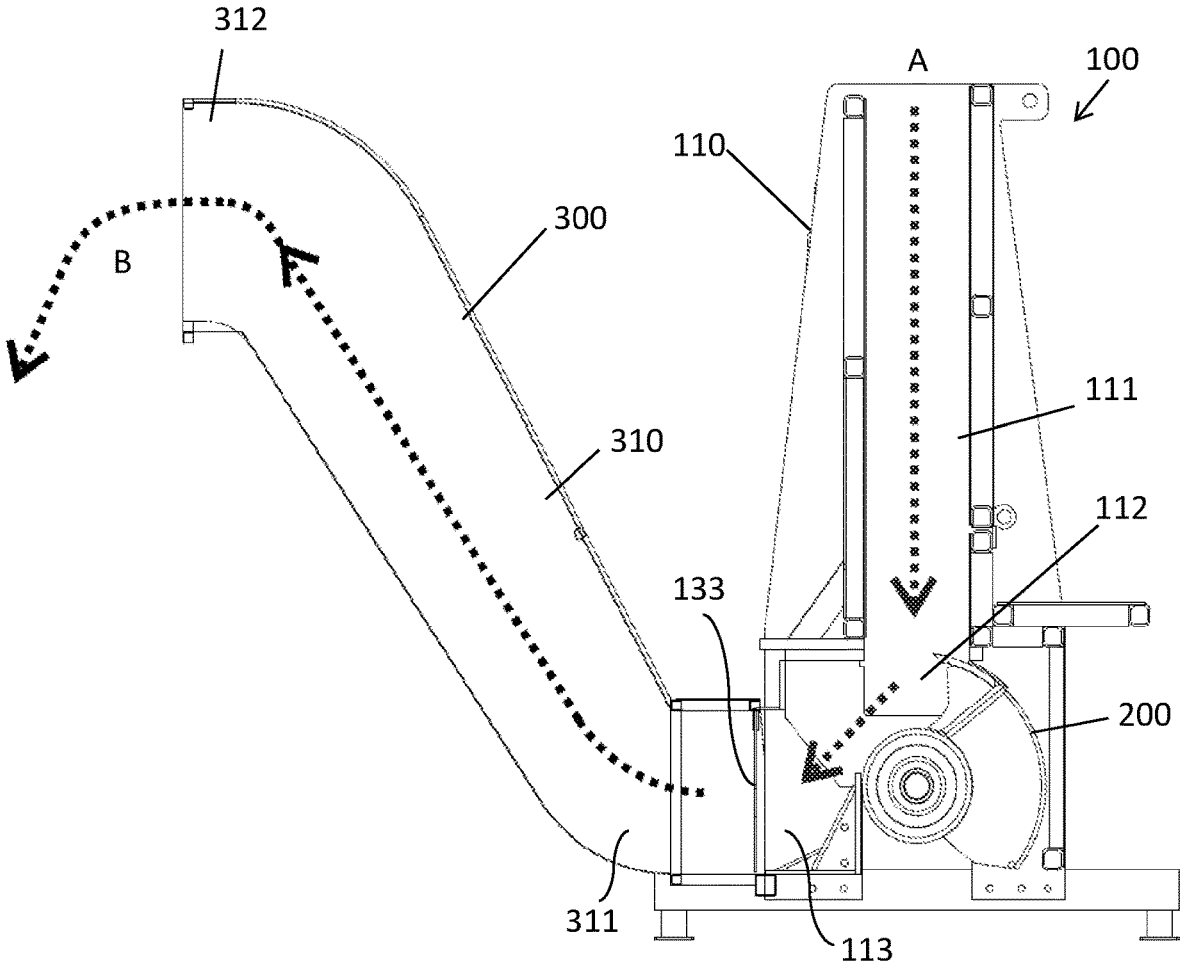
FIG. 9 is a side sectional view of the preferred form machine of FIG. 1 further including an optional chute.

Referring to FIG. 9, in a preferred embodiment of the invention, the machine further comprises an extraction chute 300 that can be coupled at one end to the opening 133 in the rear wall 130 of the housing 110 to provide flow of size reduced material from the outlet 133 of the collection chamber 113 to the chute 300. The chute 300 comprises a substantially hollow body 310 that is open at both ends 311 and 312 and that extends with a significant vertical component when coupled to the opening 133 of the housing. The chute 300 includes an overall height that allows it to rest above a standard waste collection receptacle and extends horizontally away from the machine when coupled to the opening. The chute 300 comprises an inner volume that is significantly larger than the inner volume of the collection chamber 113. The purpose of the chute is two-fold. First, it allows for broken material to be transferred over to a larger collection receptacle or container/bin. This is achieved by action of the reciprocating drum which continuously pushes broken material into the collection chamber and up the chute during the forward stroke of every oscillation cycle. Second, the vertical component of the chute 300 causes material at the top of the chute to resist against the material being pushed in the opposing direction up the chute (by the oscillating drum 210) which has the effect of compacting the broken material within the chute and collection chamber further before it is discharged into the collection container. The resistance is governed by the degree of taper in the volume of the body between the inlet and outlet of the chute. The chute therefore works synergistically with the breaking machine to increasing the density of bulk broken material output by the machine. The chute function does not require extra force on account that the cutting/breaking function is complete prior to the push force required to move the materials up the chute. In the preferred embodiment, the hydraulic actuators operating the drum are sufficiently powerful to allow material to be forced up the chute without the use of external powered assistance, such as a conveyor.

Referring to FIGS. 9-13 the stages of operation of the machine 100 will now be described in detail with reference a pallet 400. FIG. 9 shows the overall flow path of material through the machine 100 from input A, to output B. It will be appreciated the same process can be applied to a number of other objects as previously described and the invention is not intended to be limited to this particular application. In a first step shown in FIG. 10, the hinged door 142 of the machine 100 is opened to the substantially horizontal position to allow the pallet 400 to be loaded thereon. As shown in FIG. 11, pivoting of the door to the closed position then causes the pallet 400 to drop into reception chamber 111. It will be appreciated that the first step of loading may not be necessary in alternative embodiments and the pallet or other object could be directly located into the reception chamber 111 by the operator. Due to the significant vertical component of the reception chamber 111, the pallet is gravitationally forced towards the cutting region 112 of the machine 100. In particular, a lower portion 410 of the pallet 400 is received by the magazine or cavity 263 formed by the plates 262 of the breaking screen. In this state, the drum 210 and cutting head 220 are in a retracted position where the path between the reception chamber 111 and the cutting region 112 is substantially or completely unobstructed.

Figure 12:
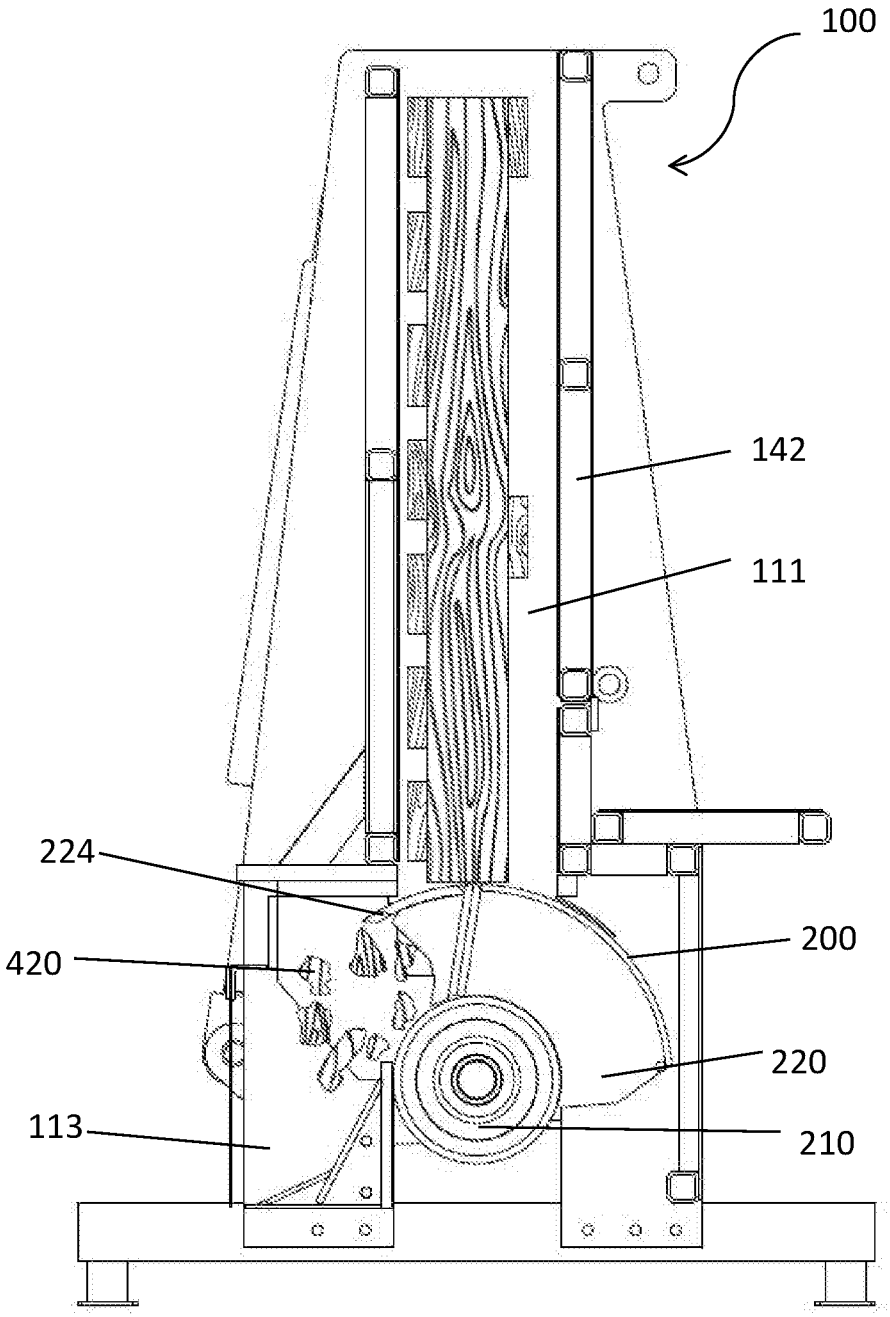
FIG. 12 is a side sectional view of the machine of FIG. 1 in use, showing the mechanism during cutting and breaking operational stages.

When the operator sees fit, for example when the door 142 is locked after being rotated into the closed position, the actuators 250 are operated (via the control system) to reciprocate and cause the drum 210 to oscillate between the fully retracted position of FIG. 11 and the fully advanced position in which the cutting head penetrates into the collection chamber 113 (shown in FIG. 13), and back. Referring to FIG. 12, during each oscillation cycle, as the cutting head 220 moves with the drum toward the breaking screen 260, the drum progressively moves into a number of different rotational positions for activating various cutting, breaking and shearing stages of the machine. When the drum rotates to the cutting position where the blades 224 contact the lower section of the pallet in the cutting region, a first cutting stage is initiated. In the first cutting stage the blades 224 (and in particular the cutting teeth 224*a*) penetrate through the lower end 410 of the pallet 400 and, in conjunction with the stationary breaking plates 262, cut one or more sections 420 off the lower end 410 of the pallet 400 accordingly. In the preferred embodiment, the orientation of the cutting teeth 224*a* causes one or more sections to be cut off the pallet along a first plane that is substantially parallel with the longitudinal axis of the drum 210.

Figure 13:
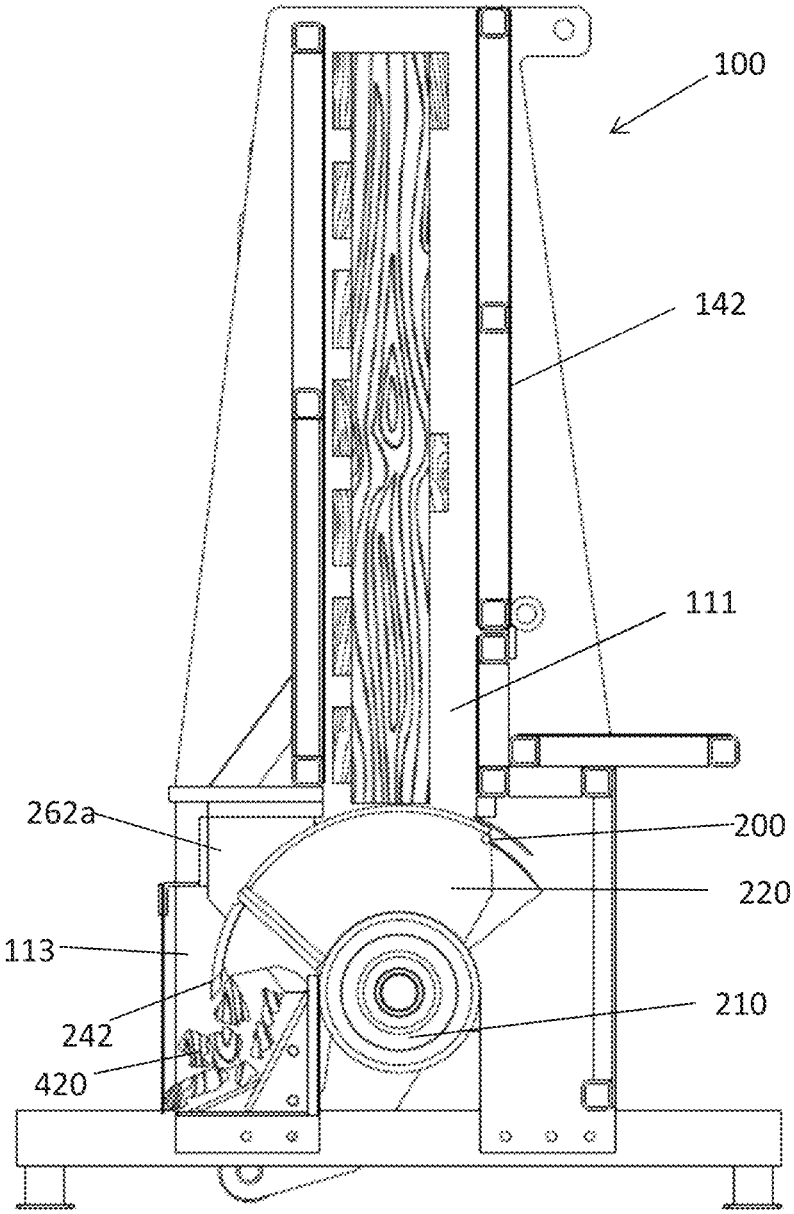
FIG. 13 is a side sectional view of the machine of FIG. 1 in use, showing the mechanism during final cutting and breaking operational stages.

Referring to FIG. 13, as the cutting head 220 continues to rotate toward the collection chamber 113, it moves into a breaking position where the ribs 224*b* locate adjacent the breaking plates 262. In this rotational position of the drum 210, a second breaking stage is initiated where sections of cut pallet material that are too large to traverse through the breaking screen 260 are broken down further. In the secondary breaking stage, the relatively large sections and/or pieces cut from the pallet are braced between adjacent plates 262 and pressure is exerted at an intermediate portion therebetween by the rotating blades 224 (and in particular by the ribs 224*b* of the blades 224) to break the sections/pieces into multiple smaller pieces. In the preferred embodiment, the orientation of the breaking plates 262 and/or ribs 224*b* causes the one or more cut section to be broken further along a second plane that is substantially orthogonal to the first plane, and substantially orthogonal to the longitudinal axis of the drum 210. The smaller pieces of broken pallet 420 can then traverse between the plates 262 and into the collection chamber 113. As the cutting head 220 continues to rotate from the breaking position towards the fully advanced position, the face 223 of the cutting head forces the pieces of broken pallet 420 into collection chamber 113. At this stage, the drum may rotate into a shearing position where the blades 224 substantially overlap with the first portion 262*a* of the breaking plates to cause a final shredding/shearing stage to occur between the edges of the cutting blade 224 and the first portion 262*a* of a breaking plate 262.

As the cutting head 220 and drum 210 rotate into the cutting and breaking stages/positions (shown in FIGS. 12 and 13), it moves into a position that substantially obstructs and/or closes the path between the reception chamber 111 and the cutting region 112 thereby preventing the next section of pallet from dropping further into the cutting region until the following oscillation cycle. This allows for all the broken pieces formed from the current oscillation cycle to first be cut, broken and forced into the collection chamber. When the drum moves back to the fully retracted position shown in FIG. 11, the path between the reception chamber 111 and the cutting region 112 is open or substantially unobstructed again allowing for the next section of pallet 400 to drop into the cutting region 112 to repeat the cutting and breaking cycles.

As previously described, when the drum 210 and cutting head 220 rotate to the fully advanced position the cutting head forces broken material 420 into the collection chamber 113 and if this is full, it will cause push the bulk material up the chute 300. As material in the chute builds up it will cause a counter weight action that resists against the rotation of the drum 210 to compact the broken material 420 residing therebetween, thereby further compacting the bulk material before disposal.

Some of the advantages of the above-described method and construction for object bulk size reduction include:

- Low speed oscillation results in a less noisy and much safer working environment for the operator;
- Relatively low dust emissions;
- Low level of wear of the moving components which operate at relatively low speeds prolonging lifetime and reducing servicing requirements;
- Relatively low cost of manufacture;
- Reduced size for improved portability; and
- Reduction of pallet bulk by approximately up to 90 percent.

The foregoing description of the invention includes preferred forms thereof. Modifications may be made thereto without departing from the scope of the invention as defined by the accompanying claims.

The invention claimed is:

1. A machine for breaking and reducing the bulk size of one or more objects, the machine comprising:

- a frame;
- a reception chamber for receiving and accommodating the one or more objects to be broken;
- a drum rotatably coupled to the frame and configured to oscillate relative to the frame between a first, fully retracted position and a second, fully advanced position about a longitudinal rotational axis;
- a cutting member coupled to the drum and extending therefrom, the cutting member being configured to penetrate through one or more of the objects in the reception chamber during operation as the drum rotates from the first position to the second position during each oscillation cycle; and
- a breaking screen located within a path traversed by the cutting head as the drum rotates from the first position to the second position to cooperate with the cutting head during operation, the breaking screen is fixedly coupled to the frame and stationary during operation, the breaking screen comprising a plurality of breaking plates extending along a plane substantially orthogonal to a longitudinal axis of the drum and configured to cause further breakdown of the one or more pieces of the one or more objects during operation as the drum rotates toward the second position during each oscillation cycle and forces the one or more pieces against the breaking plates, wherein each breaking plate comprises a leading breaking edge against which the one or more objects or the one or more pieces of the one or more objects are braced and broken against during operation and a curved portion configured to wrap around a portion of a circumference of the drum during operation, and the plurality of breaking plates are substantially parallel and spaced along an axis substantially parallel to the orthogonal axis of the drum and form a magazine within a path traversed by the cutting head during operation for supporting the one or more objects received within the reception chamber during operation.

2. The machine as claimed in claim 1, wherein the cutting member is configured to cut the one or more objects along a first plane that is substantially parallel to the longitudinal axis of the drum, and the breaking screen is oriented and configured to break the one or more pieces along a second plane that is substantially orthogonal to the first plane and/or the longitudinal axis of the drum.

3. The machine as claimed in claim 2, wherein the cutting member is configured to cooperate with the breaking screen during operation to penetrate and cut one or more pieces of the one or more objects as the drum rotates towards the second position and causes the one or more objects to be wedged between the cutting member and the breaking screen, the cutting member comprises a cutting head having a main body extending laterally from the drum and extending longitudinally along a length of the drum, and a series of spaced slots extending from a face of the main body opposing the breaking screen and into the cutting head across at least a portion of the width of the cutting head and at least a portion of the depth of the main body.

4. The machine as claimed in claim 3, wherein each slot is configured to receive and accommodate a corresponding breaking plate of the breaking screen during operation as the drum rotates from the first position to the second position.

5. The machine as claimed in claim 4, wherein an upper surface of the cutting head, most distal and/or opposing the drum, is substantially curved and a circumferential length of the upper surface is larger than a width of the reception chamber such that the upper surface momentarily shuts off a path between the reception chamber and the drum during operation as the drum oscillates between the first and second positions.

6. The machine as claimed in claim 5, wherein the cutting head extends across a portion of the circumference of the drum.

7. The machine as claimed in claim 3, wherein the cutting member comprises one or more cutting blades extending from a longitudinal peripheral edge of the cutting head, and the one or more cutting blades project laterally from adjacent an upper surface of the cutting head.

8. The machine as claimed in claim 7, wherein the cutting member comprises a plurality of cutting blades that are spaced along the longitudinal peripheral edge of the cutting head.

9. The machine as claimed in claim 8, wherein each cutting blade is located between a pair of adjacent slots of the main body and spaced from the adjacent cutting blade(s).

10. The machine as claimed in claim 1, wherein the plurality of breaking plates form the magazine for supporting the one or more objects received within the reception chamber during operation.

11. The machine as claimed in claim 10, wherein the plurality of breaking plates extending along a plane substantially orthogonal to a longitudinal axis of the drum, and the plurality of spaced plates of the breaking screen are aligned with the plurality of spaced slots of the cutting head such that the plates are received within the complementary shaped slots when the drum is rotated into the second position during each oscillation cycle.

12. The machine as claimed in claim 11, wherein the machine comprises a substantially enclosed, hollow housing forming the frame to which the drum and breaking screen are fixed, and having a cutting region located adjacent the reception chamber and on one side of the breaking screen for accommodating the drum and the cutting member, the housing comprising a collection chamber located on an opposing side of the breaking screen to the cutting region, for accommodating at least some of the broken pieces of the one or more objects output from the breaking screen during operation, and the reception chamber is located above the cutting region and is oriented with a substantially vertical component allowing the one or more objects received by the chamber to traverse through to the cutting region under the force of gravity during operation.

13. The machine as claimed in claim 12, wherein the enclosed housing comprises a door adjacent the reception chamber that is pivotable between an open position and a closed position, and the door is adjacent the reception chamber and in the open position is oriented substantially horizontally to thereby form a mounting platform for placing the one or more objects thereon, and wherein pivoting of the door from the open position to the closed position causes the one or more objects placed thereon to move into the reception chamber and traverse down to the cutting region of the housing.

14. The machine as claimed in claim 6, further comprising one or more actuators coupled to the drum for oscillating the drum between the first and second positions, the one or more actuators are hydraulically operated actuators, and a link arm extends from either end of the drum and is coupled at an end distal from the drum to a linear actuator reciprocally moveable to oscillate the drum.

15. The machine as claimed in claim 12, further comprising a substantially hollow chute having an inlet at one end and an outlet at an opposing end, wherein the inlet of the chute is configured to couple an outlet of the collection chamber, a path between the inlet of the chute and the outlet through which bulk material from the collection chamber traverses is angled upwards when the chute is coupled to the collection chamber to cause compaction of the bulk material as it traverses to the outlet of the chute for disposal, and the chute is releasably coupled to the collection chamber.

16. A system for breaking and reducing the bulk size of one or more objects, the system comprising:

a feeding system for receiving and feeding the one or more objects to be broken into a cutting region;

a drum within the cutting region and configured to oscillate between a first, fully retracted position and a second, fully advanced position about a longitudinal rotational axis;

a cutting member coupled to the drum and extending therefrom, the cutting member being configured to repeatedly penetrate through the cutting region to cut one or more pieces off the one or more objects during operation as the drum rotates from the first position to the second position during each oscillation cycle;

a breaking screen located within a path traversed by the cutting head as the drum rotates from the first position to the second position to cooperate with the cutting head during operation, the breaking screen is fixedly coupled to the frame and stationary during operation, the breaking screen comprising a plurality of breaking plates extending along a plane substantially orthogonal to a longitudinal axis of the drum and configured to cause further break down of the one or more pieces of the one or more objects during operation as the drum rotates toward the second position during each oscillation cycle and forces the one or more pieces against the breaking plates, wherein each breaking plate comprises a leading breaking edge against which the one or more objects or the one or more pieces of the one or more objects are braced and broken against during operation and a curved portion configured to wrap around a portion of a circumference of the drum during operation, and the plurality of breaking plates are substantially parallel and spaced along an axis substantially parallel to the orthogonal axis of the drum and form a magazine within a path traversed by the cutting head during operation for supporting the one or more objects received within the reception chamber during operation.

17. A bulk size reduction mechanism for breaking and reducing the bulk size of one or more objects, the mechanism comprising:

a drum configured to oscillate relative between a first position and a second position about a longitudinal rotational axis;

a cutting member coupled to the drum and extending therefrom, the cutting member being configured to penetrate through one or more of the objects during operation as the drum rotates from the first position to the second position during each oscillation cycle; and a breaking screen located within a path traversed by the cutting head as the drum rotates from the first position to the second position to cooperate with the cutting head during operation, the breaking screen is fixedly coupled to the frame and stationary during operation, the breaking screen comprising a plurality of breaking plates extending along a plane substantially orthogonal to a longitudinal axis of the drum and configured to cause further breakdown of the one or more pieces of the one or more objects during operation as the drum rotates toward the second position during each oscillation cycle and forces the one or more pieces against the breaking plates, wherein each breaking plate comprises a leading breaking edge against which the one or more objects or the one or more pieces of the one or more objects are braced and broken against during operation and a curved portion configured to wrap around a portion of a circumference of the drum during operation, and the plurality of breaking plates are substantially parallel and spaced along an axis substantially parallel to the orthogonal axis of the drum and form a magazine within a path traversed by the cutting head during operation for supporting the one or more objects received within the reception chamber during operation.

* * * * *